US009388953B2

(12) United States Patent
Workman et al.

(10) Patent No.: US 9,388,953 B2
(45) Date of Patent: Jul. 12, 2016

(54) SOLAR POWERED FLASHLIGHT

(71) Applicant: Goal Zero LLC, Bluffdale, UT (US)

(72) Inventors: Robert E. Workman, Morgan, UT (US); Norman L. Krantz, Draper, UT (US); Henry J. Howell, Herriman, UT (US); Fred K. Lillywhite, Cottonwood Heights, UT (US)

(73) Assignee: GOAL ZERO LLC, Bluffdale, UT (US)

( * ) Notice: Subject to any disclaimer, the term of this patent is extended or adjusted under 35 U.S.C. 154(b) by 63 days.

(21) Appl. No.: 14/447,361

(22) Filed: Jul. 30, 2014

(65) Prior Publication Data

US 2016/0033093 A1 Feb. 4, 2016

(51) Int. Cl.

| | |
|---|---|
| ***F21L 4/08*** | (2006.01) |
| ***F21L 13/06*** | (2006.01) |
| *F21Y 101/02* | (2006.01) |
| *F21Y 105/00* | (2016.01) |

(52) U.S. Cl.

CPC . *F21L 4/08* (2013.01); *F21L 13/06* (2013.01); *F21Y 2101/02* (2013.01); *F21Y 2105/001* (2013.01)

(58) Field of Classification Search

CPC ..... F21L 2/00; F21L 4/08; F21L 27/00; F21L 14/02; F21L 14/026; F21L 4/005; F21L 7/00; F21L 4/027; F21L 4/04; F21L 13/00; F21L 13/06; F21L 14/00; F21L 4/00; F21L 4/02; F21S 9/037; F21S 9/03; F21V 17/108; F21W 2111/02; F21W 2111/06; F21Y 2101/02; F21Y 2103/003; F21Y 2105/001; F21Y 2113/005; H02J 3/383; H02J 7/14; H02S 30/20; H02S 40/38

See application file for complete search history.

(56) References Cited

U.S. PATENT DOCUMENTS

| | | | | | |
|---|---|---|---|---|---|
| 4,648,013 | A * | 3/1987 | Curiel | F21L 4/08 | 136/251 |
| 4,668,120 | A * | 5/1987 | Roberts | E01F 9/002 | 404/12 |
| 4,884,017 | A * | 11/1989 | Williams | F21L 11/00 | 136/291 |
| 5,782,552 | A * | 7/1998 | Green | E01F 9/065 | 362/183 |
| 5,984,570 | A * | 11/1999 | Parashar | E01F 9/065 | 362/153.1 |
| 6,174,070 | B1 * | 1/2001 | Takamura | F21L 11/00 | 340/946 |
| 6,602,021 | B1 * | 8/2003 | Kim | E01F 9/065 | 116/63 R |
| 6,914,340 | B2 * | 7/2005 | Becker | F21L 13/06 | 290/1 C |
| 6,926,423 | B2 * | 8/2005 | Bucher | F21S 10/04 | 362/184 |
| 6,959,999 | B2 * | 11/2005 | Lee | F21L 13/06 | 362/183 |

(Continued)

OTHER PUBLICATIONS

U.S. Appl. No. 14/326,258, filed Jul. 8, 2014, Goal Zero LLC.

(Continued)

*Primary Examiner* — Hargobind S Sawhney
(74) *Attorney, Agent, or Firm* — Foley & Lardner LLP

(57) ABSTRACT

A portable lighting device includes a housing, a battery, a lighting element coupled to the battery, and a solar panel. The housing includes a first wall coupled to a second wall and defines an internal volume. The battery is positioned within the internal volume. The solar panel is disposed along the first wall and coupled to the battery. The second wall of the housing is angled relative to the first wall of the housing such that the solar panel is positioned in a target orientation when the second wall is disposed along a support surface.

15 Claims, 9 Drawing Sheets

(56) References Cited

U.S. PATENT DOCUMENTS

| | | | | |
|---|---|---|---|---|
| 7,070,299 | B2 * | 7/2006 | Williams | B64F 1/20 362/231 |
| 7,794,103 | B2 * | 9/2010 | Hoover | E01F 13/044 362/153.1 |
| 7,794,104 | B2 * | 9/2010 | Wu | F21V 33/0064 362/184 |
| D629,746 | S | 12/2010 | Workman et al. | |
| 8,080,972 | B2 | 12/2011 | Smith | |
| D651,564 | S | 1/2012 | Workman et al. | |
| D664,499 | S | 7/2012 | Workman et al. | |
| 8,231,240 | B1 * | 7/2012 | Rubio | E01F 9/065 136/203 |
| D670,244 | S | 11/2012 | Workman et al. | |
| 8,434,894 | B2 | 5/2013 | Workman et al. | |
| 8,956,002 | B2 * | 2/2015 | Carr | E01F 9/0536 362/190 |
| 2007/0297167 | A1 * | 12/2007 | Greenhoe | F21S 9/032 362/183 |
| 2009/0046451 | A1 * | 2/2009 | Hoover | E01F 13/044 362/183 |
| 2012/0281392 | A1 | 11/2012 | Workman et al. | |
| 2013/0043826 | A1 | 2/2013 | Workman et al. | |
| 2013/0181661 | A1 | 7/2013 | Workman et al. | |
| 2013/0183562 | A1 | 7/2013 | Workman et al. | |
| 2013/0286280 | A1 * | 10/2013 | Siann | H04N 5/2252 348/372 |
| 2014/0321106 | A1 | 10/2014 | Workman et al. | |

OTHER PUBLICATIONS

U.S. Appl. No. 29/458,766, filed Jun. 21, 2013, Goal Zero LLC.
U.S. Appl. No. 29/461,448, filed Jul. 23, 2013, Goal Zero LLC.
U.S. Appl. No. 29/498,046, filed Jul. 30, 2014, Krantz et al.
U.S. Appl. No. 62/022,631, filed Jul. 9, 2014, Workman et al.

* cited by examiner

SOLAR POWERED FLASHLIGHT

BACKGROUND

The present disclosure relates to portable lighting devices. In particular, the present disclosure relates to a flashlight that includes a solar panel.

Portable lighting devices often include one or more batteries used to power various lights. An operator may utilize the portable lighting device for targeted lighting (e.g., to illuminate a particular object) or to provide general lighting (e.g., to illuminate a room). The batteries may be single use or may be rechargeable. An operator may remove the batteries for charging or plug a specialized connector into the portable lighting device to charge the batteries.

SUMMARY

One embodiment of the disclosure relates to a portable lighting device that includes a housing, a battery, a lighting element coupled to the battery, and a solar panel. The housing includes a first wall coupled to a second wall and defines an internal volume. The battery is positioned within the internal volume. The solar panel is disposed along the first wall and coupled to the battery. The second wall of the housing is angled relative to the first wall of the housing such that the solar panel is positioned in a target orientation when the second wall is disposed along a support surface.

Another embodiment of the disclosure relates to a portable lighting device that includes a housing, a lighting element coupled to the housing, and a solar panel. The housing includes a first surface and a second surface, and the housing defines an internal volume configured to contain a battery. The solar panel is disposed along the first surface, and at least a portion of the second surface of the housing is offset relative to the first surface of the housing such that the solar panel is positioned in a target orientation when the housing is supported along the second surface.

Still another embodiment of the disclosure relates to a portable lighting device that includes a housing, a battery positioned within an internal volume of the housing, a lighting element coupled to the battery, and a solar panel. The housing includes a first side coupled to a second side. The first side is configured to support the housing in a first orientation and the second side is configured to support the housing in a second orientation. The solar panel is coupled to the first side of the housing, and the second side is angled relative to the first side such that the solar panel generates a target electrical power when the housing is positioned in the second orientation.

The invention is capable of other embodiments and of being carried out in various ways. Alternative exemplary embodiments relate to other features and combinations of features as may be recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

According to an exemplary embodiment, a portable lighting device includes a housing that contains a battery (e.g., a rechargeable lithium ion battery) and various other components. A lighting element is coupled to the housing and positioned to direct light toward a surrounding environment. An operator may engage and disengage the lighting element to selectively illuminate a target area. By way of example, an operator may illuminate a campsite, a worksite, a work piece, a pathway, still another object, or still another environment.

The portable lighting device includes a solar panel that is coupled to the housing and configured to charge the battery, according to an exemplary embodiment. The solar panel receives solar energy and generates electrical power. The electrical power generated by the solar panel varies based on numerous factors including, among others, an angle of incidence defined between the incident solar energy and a surface of the solar panel and. In one embodiment, the housing is configured to be supported in a plurality of orientations such that an operator may vary the placement of the solar panel and thereby change the angle of incidence. A portable lighting device having such a housing may allow an operator to accommodate the various characteristics associated with the operator's use of the solar panel that may impact the performance thereof. By way of example, the portable lighting device may allow an operator to compensate for latitude, season, time of day, or still other characteristics associated with the operator's use of the solar panel.

In one embodiment, one or more components of the portable lighting device (e.g., the battery, a dynamo, etc.) are positioned to stabilize the portable lighting device in at least one of the plurality of orientations. By way of example, one or more components may be positioned such that their centers of gravity are disposed above a surface of the housing being used to support the portable lighting device. Such orientation may reduce the risk of tipping or otherwise accidentally repositioning the portable lighting device from a desired orientation.

Figure 1:
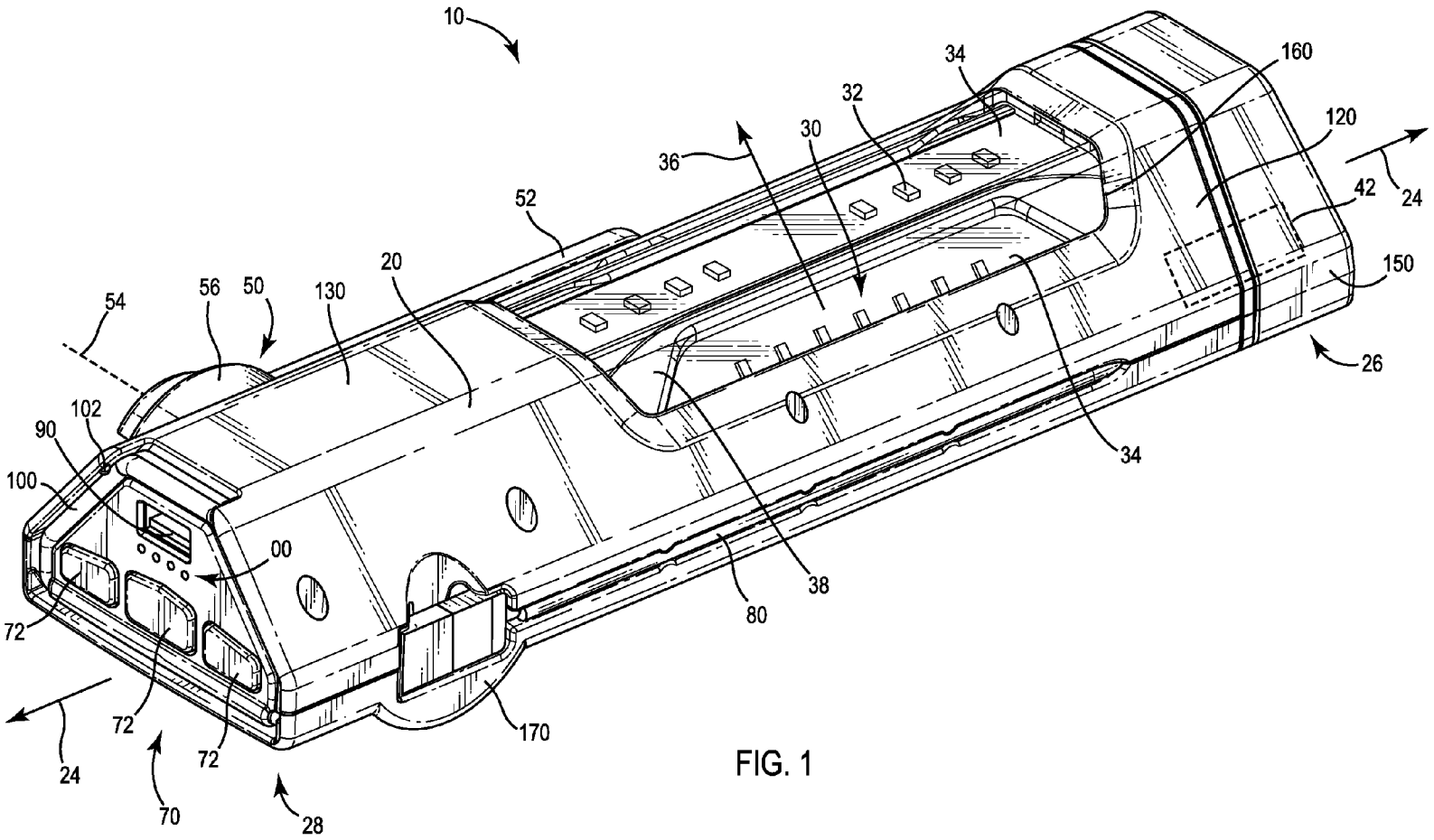
FIG. 1 is a top perspective view of a portable lighting device, according to an exemplary embodiment.

Referring to the exemplary embodiment shown in FIGS. 1-8, a portable lighting device, shown as flashlight 10, includes a housing, shown as housing 20. As shown in FIG. 1, a lighting element, shown as LED assembly 30, is coupled to housing 20. Flashlight 10 includes a solar panel, shown as solar panel 40, according to an exemplary embodiment. Housing 20 is configured to be supported in a plurality of orientations such that an operator may vary the placement of solar panel 40. Solar panel 40 may be coupled to at least one battery 42. Battery 42 may include one or more rechargeable battery cells (e.g., lithium ion battery cells, etc.). Battery 42 is charged by electrical power generated by solar panel 40, according to an exemplary embodiment. A generator, shown as dynamo 50, may also be used to generate electrical power and charge battery 42.

Figure 2:
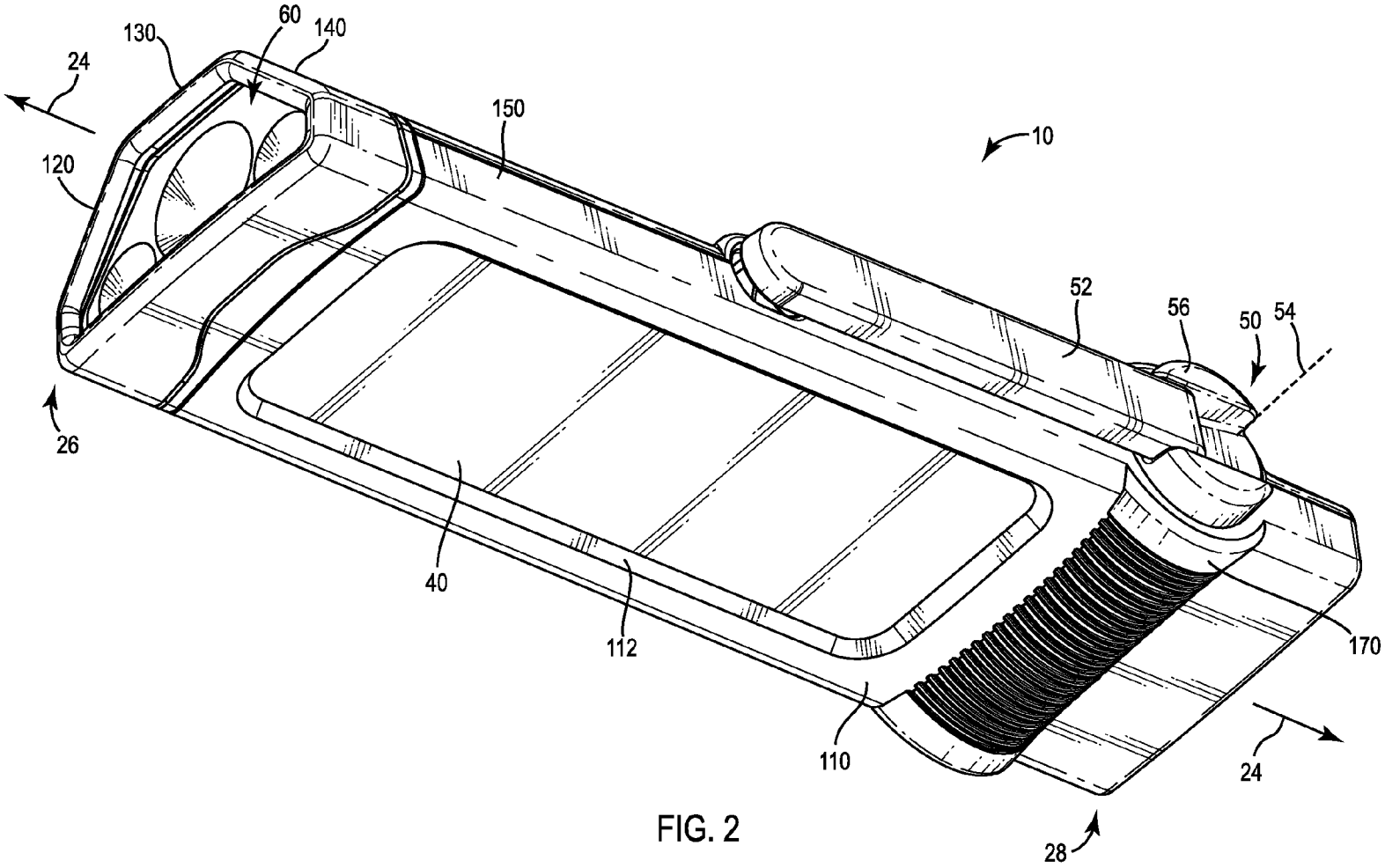
FIG. 2 is a bottom perspective view of the portable lighting device shown in FIG. 1, according to an exemplary embodiment.

As shown in FIG. 2, a lighting element, shown as light assembly 60, is coupled to an end of housing 20. As shown in FIG. 1, a user interface, shown as user interface 70, is positioned at an opposing end of housing 20. User interface 70 may be coupled to various electronic components of flashlight 10 (e.g., circuits, controllers, batteries, etc.). In one embodiment, user interface 70 is used to control a light output profile of at least one of LED assembly 30 and light assembly 60. As shown in FIGS. 1-8, a power cable, shown as USB cable 80, and an outlet, shown as USB connector 90, are coupled to housing 20. Housing 20 may be oriented at least in part using a support, shown as hook 100.

According to an exemplary embodiment, housing 20 has a plurality of sides. The plurality of sides may include walls, surfaces, faces, facets, legs, cords, or still other features. In one embodiment, each of the plurality of sides are flat and planar. In other embodiments, at least one of the plurality of sides is curved (e.g., arcuate, rounded, etc.). In still other embodiments, at least one of the sides has still another shape (e.g., irregular, etc.). The plurality of sides define an internal volume, according to an exemplary embodiment.

Figure 3:
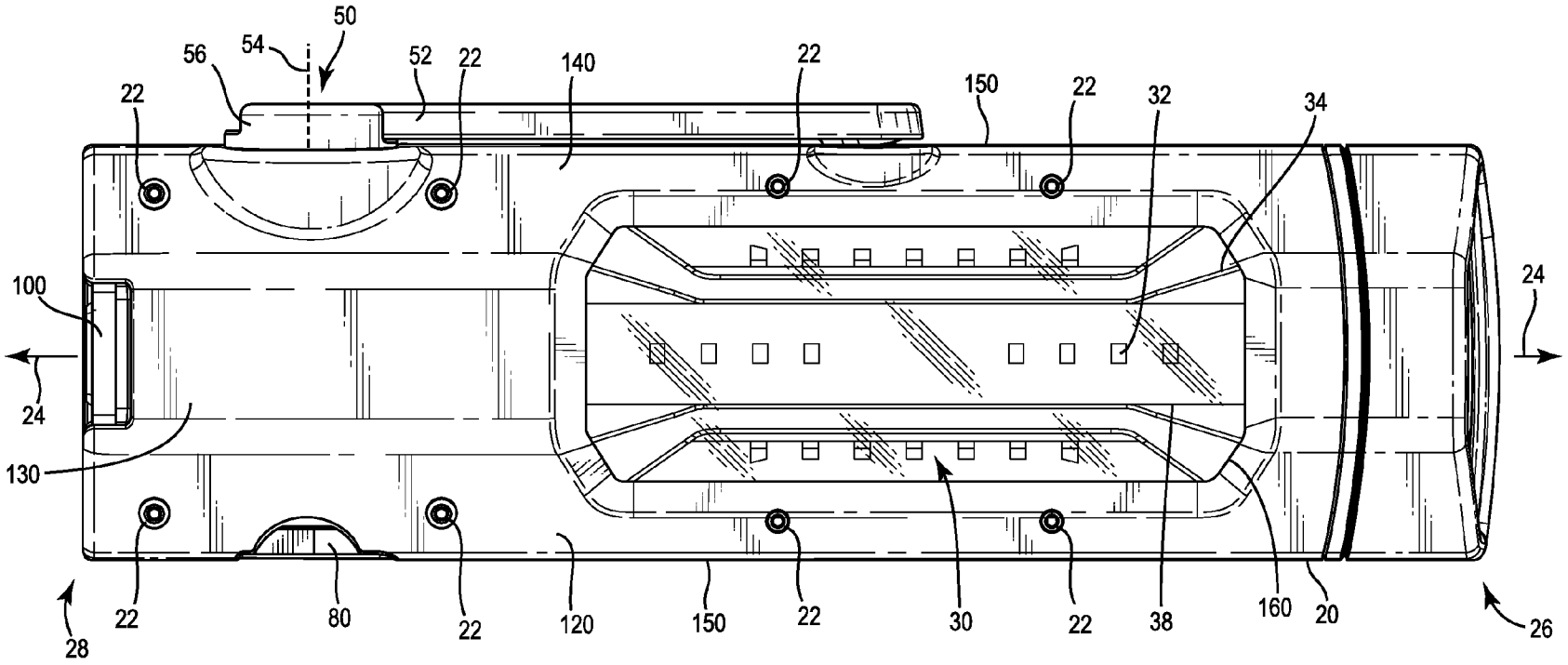
FIG. 3 is a top plan view of the portable lighting device shown in FIG. 1, according to an exemplary embodiment.
Figure 4:
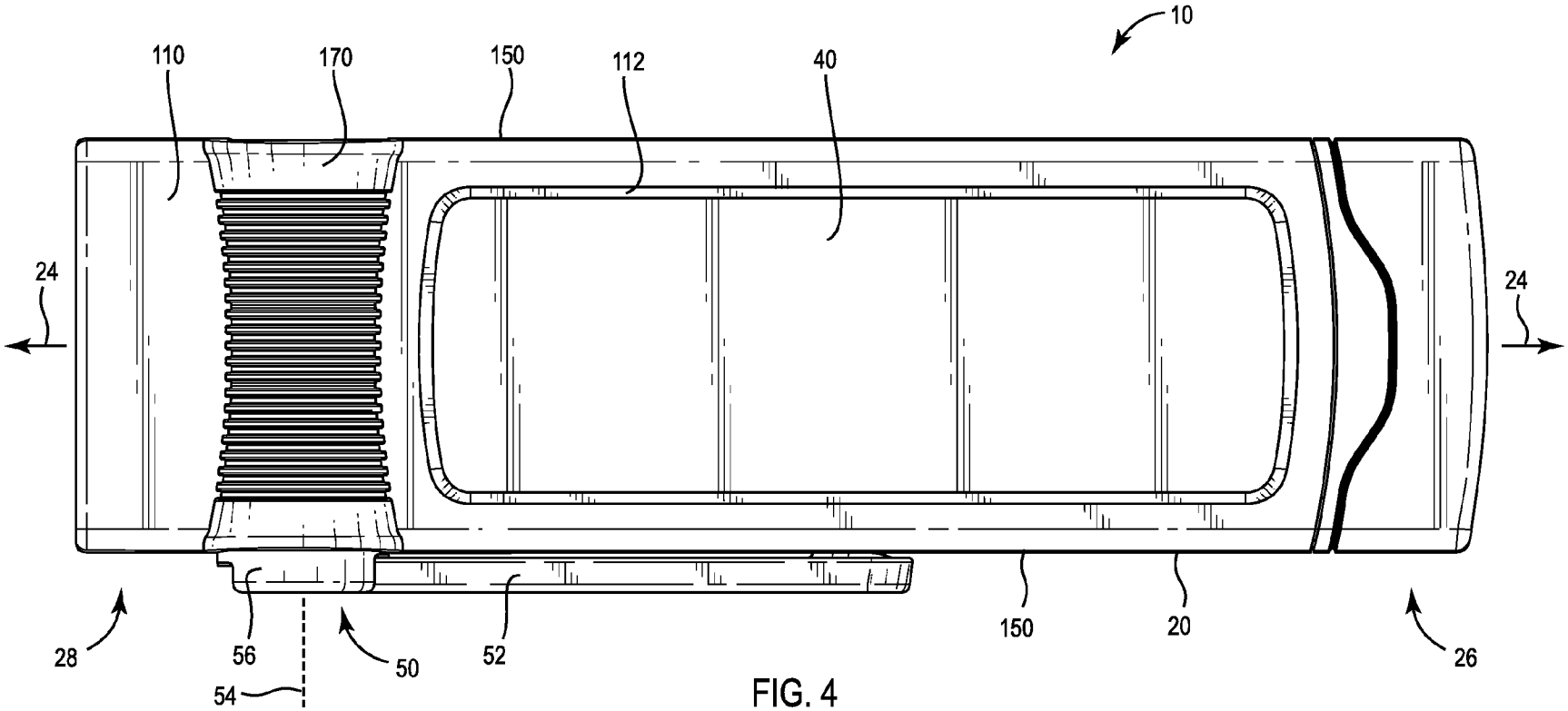
FIG. 4 is a bottom plan view of the portable lighting device shown in FIG. 1, according to an exemplary embodiment.
Figure 5:
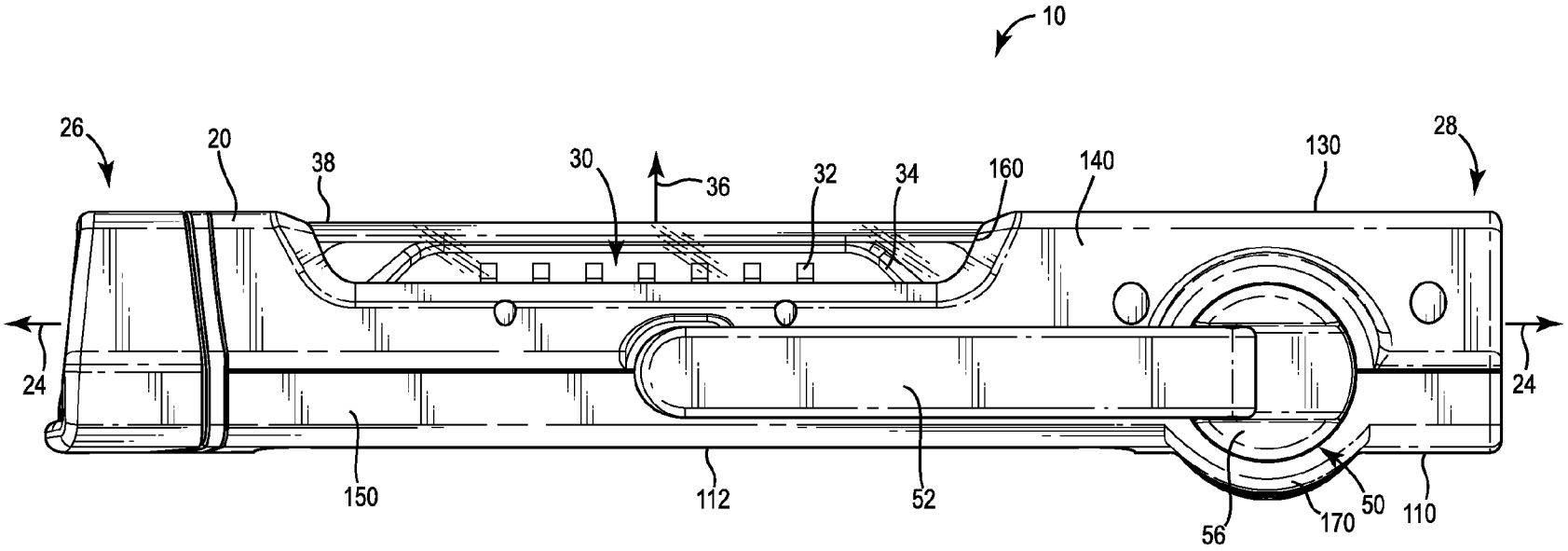
FIG. 5 is a rear plan view of the portable lighting device shown in FIG. 1, according to an exemplary embodiment.
Figure 6:
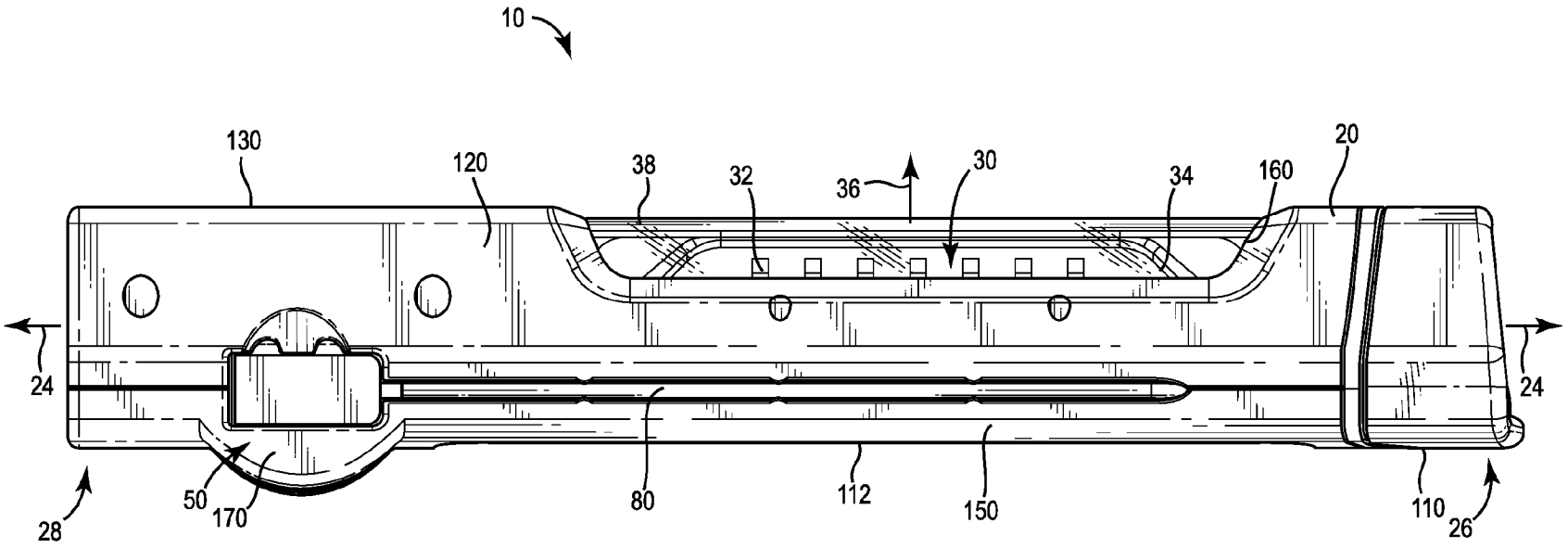
FIG. 6 is a front plan view of the portable lighting device shown in FIG. 1, according to an exemplary embodiment.
Figure 7:
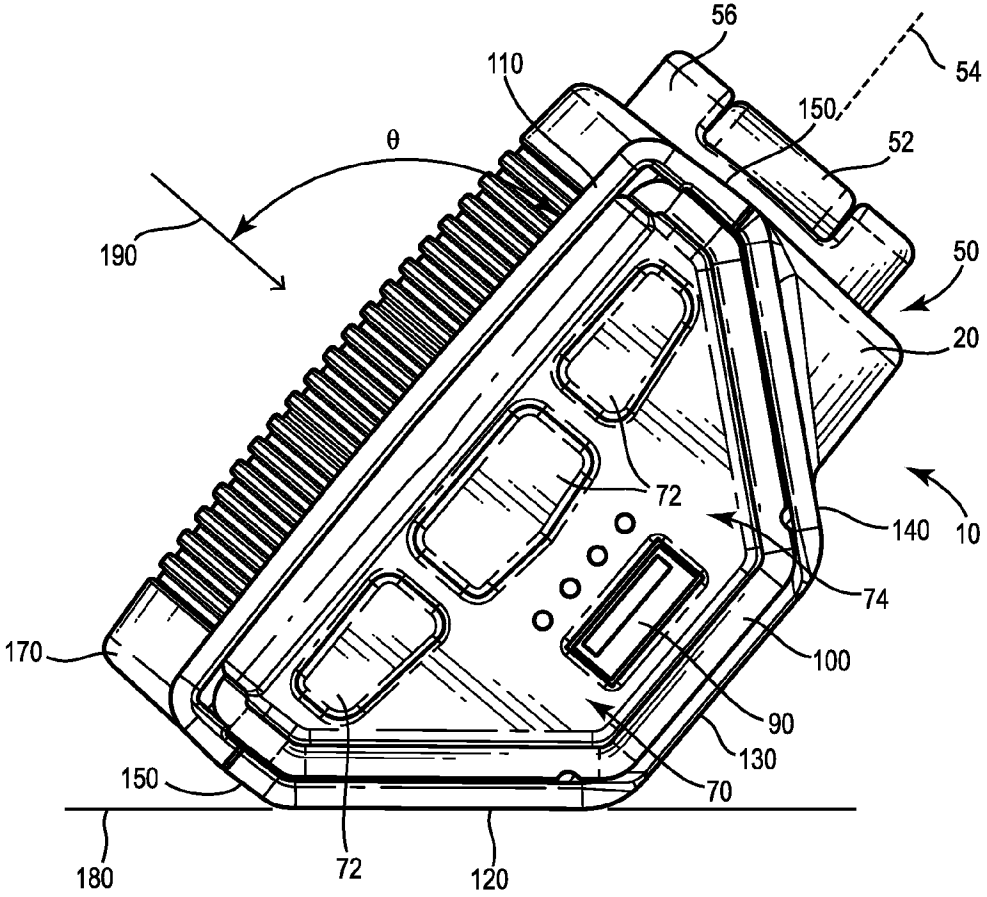
FIG. 7 is a left side view of the portable lighting device shown in FIG. 1, according to an exemplary embodiment.

Referring again to the exemplary embodiment shown in FIGS. 1-8, housing 20 includes a first side 110 and a second side 120. First side 110 is configured to support housing 20 in a first orientation and second side 120 is configured to support housing 20 in a second orientation, according to an exemplary embodiment. As shown in FIGS. 1-2, housing 20 further includes a third side 130. Third side 130 is coupled to second side 120, according to an exemplary embodiment. Housing 20 further includes a fourth side 140 and a pair of sides 150. As shown in FIG. 7, first side 110 has a curved shape. In other embodiments, first side 110 is flat. As shown in FIGS. 2, 4, and 5, first side 110 includes a recessed portion 112. In one embodiment, recessed portion 112 is configured to receive solar panel 40. As shown in FIG. 2, recessed portion 112 defines an aperture configured to receive solar panel 40. As shown in FIG. 7, second side 120, third side 130, and fourth side 140 are flat. In other embodiments, at least one of second side 120, third side 130, and fourth side 140 have a curved shape. Sides 150 are shaped to join first side 110 with second side 120 and fourth side 140, according to an exemplary embodiment.

Figure 8:
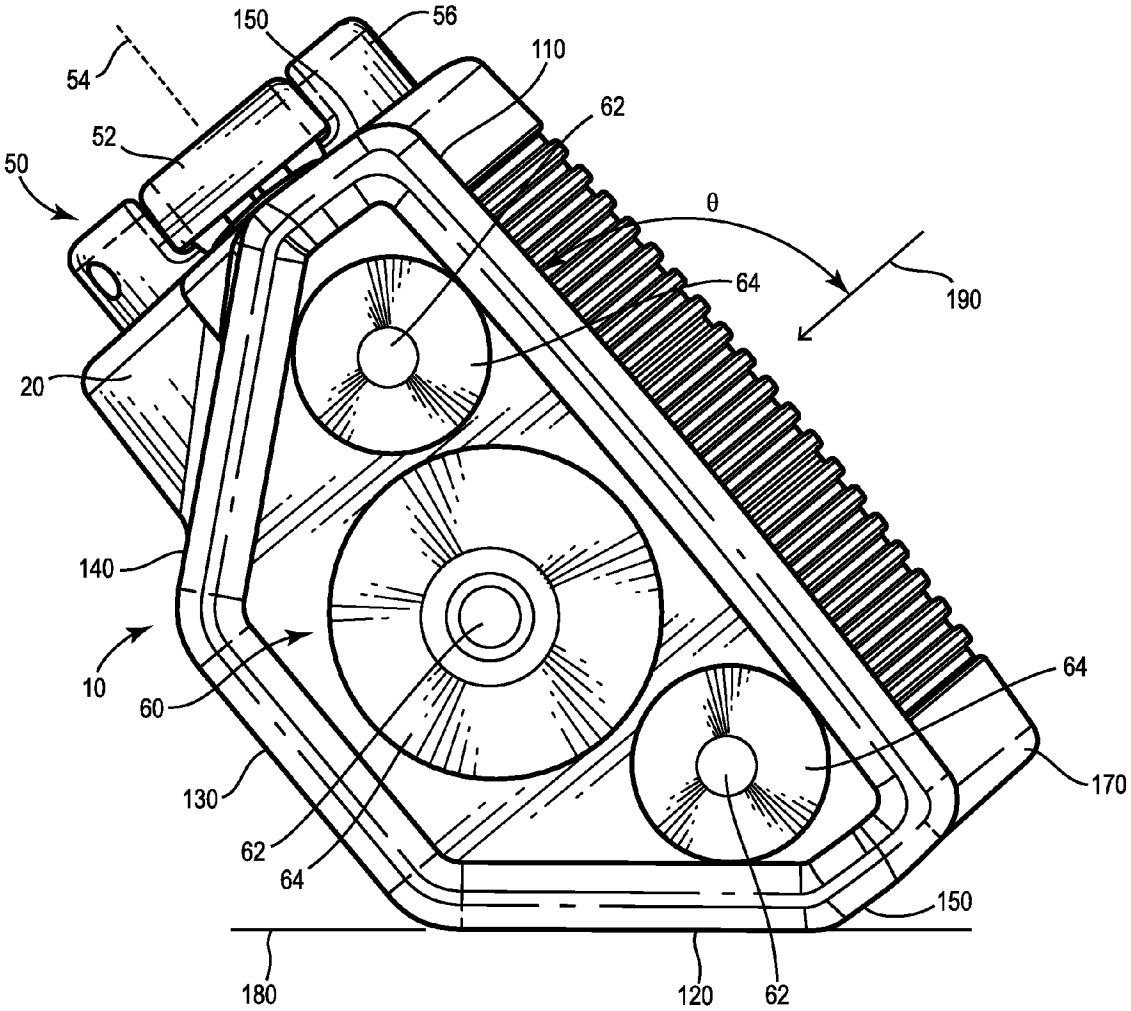
FIG. 8 is a right side view of the portable lighting device shown in FIG. 1, according to an exemplary embodiment.

According to an exemplary embodiment, first side 110 is coupled to second side 120 and fourth side 140 by sides 150. In other embodiments, first side 110 extends between second side 120 and fourth side 140. As shown in FIG. 1, second side 120 is directly coupled to third side 130 and coupled to first side 110 by a side 150. In other embodiments, second side 120 is directly coupled to (e.g., extends between, etc.) third side 130 and first side 110 (i.e., housing 20 may not include at least one of the sides 150). Third side 130 is directly coupled to second side 120 and fourth side 140. As shown in FIGS. 7-8, fourth side 140 is directly coupled to third side 130 and coupled to first side 110 by a side 150. In other embodiments, fourth side 140 is directly coupled to (e.g., extends between, etc.) third side 130 and first side 110 (i.e., housing 20 may not include at least one of the sides 150).

In one embodiment, the plurality of sides are separate components that are coupled together. By way of example, the plurality of sides may be adhesively secured together, coupled with fasteners, coupled with press fit connections, or coupled with snap fit connections, among other alternatives. In other embodiments, at least two of the plurality of sides are integrally formed and define a single unitary body. As shown in FIGS. 1-2, second side 120, third side 130, fourth side 140, and a portion of sides 150 are integrally formed and define an first shell component while first side 110 and a portion of sides 150 are integrally formed and define a second shell component. As shown in FIG. 3, a plurality of fasteners 22 are used to secure the two shell components together. In other embodiments, the first shell component is adhesively secured, coupled with a press fit connect, coupled with a snap fit connection, or still otherwise coupled to the second shell.

According to an exemplary embodiment, the plurality of sides are coupled at a plurality of interfaces. As shown in FIGS. 1-2, the plurality of interfaces define a plurality of fillets. The plurality of fillets may improve the ergonomics of flashlight 10. In other embodiments, the plurality of fillets facilitate repositioning flashlight 10 between various orientations (e.g., to facilitate rocking or tilting flashlight 10 from third side 130 to second side 120, etc.). In other embodiments, the plurality of interfaces define a plurality of edges or still other features.

Referring again to FIGS. 1-8, housing 20 is elongate and defines a longitudinal direction 24. In one embodiment, housing 20 defines a first end 26 and a second end 28. According to an exemplary embodiment, first end 26 is separated from second end 28 by a body portion of housing 20. Housing 20 may have various lengths, according to alternative embodiments, such that an offset distance between first end 26 and second end 28 varies (i.e., the length of the body portion may vary).

In one embodiment, at least one of first side 110, second side 120, third side 130, fourth side 140, and sides 150 are elongate. Elongated sides may accommodate the various components of flashlight 10 (e.g., LED assembly 30, solar panel 40, battery 42, dynamo 50, etc.). By way of example, at last one of first side 110, second side 120, third side 130, fourth side 140, and sides 150 may have a length (e.g., measured along longitudinal direction 24, etc.) that is longer than a width thereof (e.g., as measured across the side). As shown in FIGS. 1-8, first side 110, second side 120, third side 130, fourth side 140, and sides 150 are elongated and extend along longitudinal direction 24.

Referring again to FIGS. 1 and 3, LED assembly 30 is coupled to the body portion of housing 20 (i.e., LED assembly 30 is positioned between first end 26 and second end 28 of housing 20). LED assembly 30 may be coupled to battery 42 of flashlight 10. According to the exemplary embodiment shown in FIG. 1, LED assembly 30 includes a plurality of LEDs 32 disposed on a plurality of supports 34. LEDs 32 may each include a single LED element. In other embodiments, at least one LED 32 includes a plurality of LED elements (e.g., to produce light having different colors). LEDs 32 may include various components (e.g., lenses, cases, diffusers, etc.) disposed over the one or more LED elements.

LED assembly 30 is positioned to direct light primarily along a light axis 36, according to an exemplary embodiment. By way of example, an operator may use flashlight 10 having LED assembly 30 positioned to provide targeted lighting toward an object or path. According to an exemplary embodiment, light axis 36 extends along a direction that is orthogonal to first side 110. By way of example, first side 110 may extend at least partially within a plane, and light axis 36 may be orthogonal to the plane. According to an alternative embodiment, LED assembly 30 is configured to direct light generally outward within a region extending from housing 20. By way of example, an operator may use flashlight 10 having such a LED assembly 30 to provide general lighting (e.g., within a tent, etc.).

Supports 34 are angled relative to one another, according to the exemplary embodiment shown in FIGS. 1 and 3. In one embodiment, at least one support 34 is parallel to at least one of the sides of housing 20 (e.g., first side 110, etc.). Supports 34 may be angled such that LED assembly 30 provides light primarily along light axis 36. According to an alternative embodiment, supports 34 may be angled to direct light generally outward within a region extending from housing 20. The plurality of supports 34 or a subset thereof may be manufactured from a reflective material or coated with a reflective material, according to various alternative embodiments.

According to an exemplary embodiment, LED assembly 30 includes a cover, shown as lens 38, disposed over an aperture, shown as opening 160, within housing 20. Lens 38 is formed from an at least semi-transparent material. LED assembly 30 emits light through opening 160 and lens 38, according to an exemplary embodiment. Opening 160 may be defined within the body portion of housing 20. According to the exemplary embodiment shown in FIGS. 1 and 3, opening 160 is defined by portions of second side 120, third side 130, and fourth side 140. As shown in FIGS. 1 and 3, lens 38 is recessed into second side 120, third side 130, and fourth side 140, thereby protecting lens 38 from damage (e.g., when flashlight 10 is supported along second side 120 or third side 130, etc.).

Referring again to FIG. 2, solar panel 40 is disposed along first side 110. In one embodiment, solar panel 40 has a fixed orientation within flashlight 10. By way of example, solar panel 40 may be fixed or otherwise secured to housing 20 along first side 110. Fixing the orientation of solar panel 40 reduces the risk of damage to flashlight 10 by eliminating a movable connection between solar panel 40 and housing 20, according to an exemplary embodiment. In other embodiments, fixing the orientation of solar panel 40 reduces the complexity involved with operating flashlight 10 (e.g., by limiting the number of potential orientations for solar panel 40 between which an operator must choose).

According to an exemplary embodiment, solar panel 40 is positioned within the internal volume of housing 20. According to an exemplary embodiment, solar panel 40 is positioned behind (e.g., further inward of, etc.) first side 110 such that an incident surface of solar panel 40 is positioned closer to a central axis of flashlight 10 than an outer surface of first side 110. Such an orientation may protect solar panel 40 from damage. According to an alternative embodiment, solar panel 40 is positioned within first side 110 such that the incident surface of solar panel 40 is coplanar with the outer surface of first side 110. In still other embodiments, solar panel 40 protrudes from first side 110 such than the incident surface of solar panel 40 is positioned further from a central axis of flashlight 10 than the outer surface of first side 110.

Solar panel 40 includes a single solar panel such that the incident surface of solar panel 40 is defined by a single, continuous surface, according to an exemplary embodiment. According to an alternative embodiment, solar panel 40 includes a plurality of solar panels. The plurality of solar panels may be disposed adjacent to one another and along first side 110. In one embodiment, the plurality of solar panels collectively define the incident surface of solar panel 40.

Referring again to FIGS. 1-8, dynamo 50 is positioned at least partially within the internal volume of housing 20. Dynamo 50 includes a handle 52, according to an exemplary embodiment. An operator may rotate handle 52 about an axis 54 to turn various internal components of dynamo 50 (e.g., brushes, coils, etc.) to generate electrical power. According to an exemplary embodiment, an operator may fold and unfold handle 52 between a storage orientation, shown in FIGS. 1-5, and an operation orientation. In one embodiment, handle 52 is coupled to a body 56 of dynamo 50 with a pinned connection. An operator may rotate handle 52 about the pinned connection between the storage orientation and the operation orientation, according to an exemplary embodiment. In one embodiment, handle 52 may be folded 180 degrees between the storage orientation and the operation orientation.

As shown in FIGS. 2 and 4-6, housing 20 includes a protrusion 170. As shown in FIGS. 5-6, protrusion 170 extends from first side 110 (e.g., extends from an outer surface of first side 110). Protrusion 170 may define a surface upon which flashlight 10 rests when supported along first side 110. Protrusion 170 may elevate solar panel 40 relative to a support surface when flashlight 10 is supported along first side 110, thereby protecting solar panel 40 from damage, according to an exemplary embodiment. In one embodiment, protrusion 170 is integrally formed with first side 110. In other embodiments, protrusion 170 is a separate component that is coupled to first side 110. According to an exemplary embodiment, dynamo 50 is at last partially positioned within an interior of protrusion 170. In other embodiments, dynamo 50 does not extend into an inner volume of protrusion 170.

Referring to FIGS. 2 and 8, light assembly 60 includes a plurality of lights 62 coupled to first end 26 of housing 20. In one embodiment, light assembly 60 is positioned to direct light along a longitudinal direction 24 defined by housing 20. By way of example, an operator may utilize light assembly 60 to illuminate a target component or path. As shown in FIGS. 2 and 8, light assembly 60 includes three lights 62 disposed within three reflectors 64. In other embodiments, light assembly 60 includes more or fewer lights 62 and reflectors 64. In still other embodiments, light assembly 60 does not include reflectors 64.

According to an exemplary embodiment, user interface 70 includes a user input device. As shown in FIGS. 1 and 7, user interface 70 includes a plurality of user input devices, shown as buttons 72. Buttons 72 are coupled to various electronic components of flashlight 10 (e.g., circuits, controllers, battery 42, etc.), according to an exemplary embodiment. An operator may actuate buttons 72 to control a light output of (e.g., turn on, turn off, change the intensity of light provided by, etc.) at least one of LED assembly 30 and light assembly 60.

Referring again to FIGS. 1 and 7, user interface 70 includes a display, shown as battery level indicator 74. According to an exemplary embodiment, battery level indicator 74 includes a plurality of lighting elements that may be illuminated to indicate a charge level of battery 42. As shown in FIGS. 1 and 7, battery level indicator 74 includes four LEDs that may be illuminated to indicate the charge level of battery 42. In one embodiment, one of the LEDs may be illuminated to indicate a charge level of between zero and twenty five percent (e.g., percentage of a total charge level), two of the LEDs may be illuminated to indicate a charge level of between twenty five and fifty percent, three of the LEDs may be illuminated to indicate a charge level of between fifty and seventy five percent, and four LEDs may be illuminated to indicate a charge level of between seventy five percent and one hundred percent. In another embodiment, one or more LEDs is configured to flash when the charge level is below a threshold level (e.g., five percent).

In one embodiment, a first button 72 is used to control the light output of LED assembly 30, a second button 72 is used to control the light output of light assembly 60, and a third button 72 is used to engage battery level indicator 74 to display the charge level of battery 42. By way of example, the third button 72 may be used to selectively illuminate the LEDs that correspond to the charge level of battery 42. In other embodiments, battery level indicator 74 may continuously provide the operator with an indication of the charge level of battery 42.

According to an exemplary embodiment, an operator may selectively charge battery 42 using USB cable 80. By way of example, USB cable 80 may be electrically coupled with battery 42. In one embodiment, an operator may couple USB cable 80 with an electronic device (e.g., a laptop computer), an external solar panel, or still another power source (e.g., a generator, a wall socket, etc.). In other embodiments, USB cable 80 includes another type of connector (e.g., in addition to a USB connector, in place of a USB connector, etc.) that may be used to couple flashlight 10 with the electronic device, external solar panel, or still other power source.

An operator may selectively export power from flashlight 10 using USB connector 90. By way of example, USB connector 90 may be electrically coupled with battery 42 and used to provide the electrical power therefrom to another device. In one embodiment, an operator may couple an electronic device (e.g., a portable music player, a cellular telephone, etc.) to USB connector 90 (e.g., using a separate USB cable, etc.). USB connector 90 may be used to charge an onboard battery of the electronic device, power the electronic device, or charge the onboard battery while powering the electronic device. In other embodiments, USB connector 90 includes another type of connector (e.g., in addition to a USB connector, in place of a USB connector, etc.) that may be used to couple flashlight 10 with an electronic device.

In one embodiment, LED assembly 30, solar panel 40, dynamo 50, light assembly 60, user interface 70, USB cable 80, and USB connector 90 are coupled to battery 42. Battery 42 may be disposed within an internal volume defined by housing 20. In another embodiment, battery 42 is releasably coupled to an outer portion of housing 20 such that an operator may selectively remove battery 42. Dynamo 50 may be used to at least one of charge battery 42 and directly power at least one of LED assembly 30 and light assembly 60. Solar panel 40 may be used to at least one of charge battery 42 and directly power at least one of LED assembly 30 and light assembly 60. In other embodiments, flashlight 10 does not include solar panel 40 or does not include dynamo 50.

According to an exemplary embodiment, an operator may at least partially orient flashlight 10 using hook 100. As shown in FIGS. 1, 3, and 7, hook 100 is coupled to second end 28 of housing 20. In one embodiment, hook 100 has a circular cross section and contours a profile (e.g., a side profile, etc.) of housing 20. In other embodiments, hook 100 has still another shape. Hook 100 extends continuously between a pair of ends that are coupled to housing 20, according to an exemplary embodiment. Hook 100 is releasably secured in a storage orientation, shown in FIGS. 1, 3, and 7, by a retainer, shown as protrusion 102. Protrusion 102 extends from housing 20 and holds hook 100 in the storage orientation, according to an exemplary embodiment. An operator may actuate (e.g., open, etc.) hook 100 into an operational orientation.

Referring again to FIGS. 7-8, second side 120 is offset from first side 110. In other embodiments, at least a portion of second side 120 is offset from at least a portion of first side 110. As shown in FIGS. 7-8, second side 120 is angled relative to first side 110. In one embodiment second side 120 is positioned at an angle of between forty five and fifty five degrees (e.g., fifty degrees, etc.) relative to first side 110. In one embodiment, second side 120 defines a plane that is angularly offset from a plane defined by first side 110. In other embodiments, at least a portion of second side 120 is angularly offset relative to first side 110. In one embodiment, third side 130 is offset from (e.g., angled relative to, etc.) first side 110 and second side 120. By way of example, third side 130 may be positioned at an angle of between 125 and 135 degrees (e.g., 130 degrees, etc.) relative to second side 120. At least a portion of third side 130 may be parallel to first side 110. Fourth side 140 is angled relative to second side 120, according to the exemplary embodiment shown in FIGS. 7-8. In one embodiment, fourth side 140 is positioned at an angle of between seventy and ninety degrees (e.g., seventy eight degrees, etc.) relative to second side 120.

Referring again to FIGS. 7-8, flashlight 10 is supported by a support surface 180. By way of example, support surface 180 may be a surface of a table, the ground, a stand, or still another object within the environment surrounding flashlight 10. As shown in FIGS. 7-8, second side 120 is disposed along support surface 180 (i.e., housing 20 is supported along second side 120).

Solar panel 40 is configured to receive incoming solar energy 190 and generate electrical power, according to an exemplary embodiment. While shown schematically as a single ray, it should be understood that incoming solar energy 190 may include a plurality of solar rays that may travel along various paths. In one embodiment, incoming solar energy 190 illustrates a direction along which a majority of the incoming solar energy travels. As shown in FIGS. 7-8, incoming solar energy 190 is angled. By way of example, incoming solar energy 190 may be angled relative to support surface 180. In one embodiment, an angle of incidence θ is defined between incoming solar energy 190 and an incident surface of solar panel 40. Solar panel 40 may produce electrical power that varies based on the angle of incidence θ. In one embodiment, solar panel 40 produces a maximum electrical power when the angle of incidence θ is equal to ninety degrees. According to an alternative embodiment, the angle of incidence is defined between incoming solar energy 190 and an axis that is orthogonal to the incident surface of solar panel 40. Solar panel 40 may produce a maximum electrical power when the angle of incidence is equal to zero degrees.

According to an exemplary embodiment, second side 120 is offset from first side 110 (e.g., angled, etc.) such that solar panel 40 is positioned (e.g., supported, held, etc.) in a target orientation when second side 120 is disposed along support surface 180. By way of example, second side 120 may be offset from first side 110 (e.g., angled, etc.) such that solar panel 40 generates a target electrical power when housing 20 is positioned (e.g., supported, held, etc.) in the second orientation (e.g., an orientation in which second side 120 is configured to support housing 20). In other embodiments, second side 120 is offset from first side 110 (e.g., angled, etc.) such that solar panel 40 is positioned (e.g., supported, held, etc.) in the target orientation when housing 20 is otherwise supported along second side 120.

The target orientation is a position that increases (e.g., maximizes, etc.) the electrical power output of solar panel 40, according to an exemplary embodiment. In one embodiment, the target orientation is a position that at least partially compensates for changes in latitude, season, time of day, or still other characteristics associated with the operator's use of flashlight 10. In another embodiment, the target orientation is a position at which incident solar energy 190 is perpendicular to solar panel 40. In still another embodiment, the target orientation is a position that reduces (e.g., minimizes, etc.) the difference between the angle of incidence and ninety or zero degrees. The target electrical output may relate to the characteristics (e.g., area, composition, etc.) of solar panel 40 and the target orientation. In one embodiment, the target electrical output is equal to the electrical power output of solar panel 40 when solar panel 40 is positioned (e.g., supported, held, etc.) in the target orientation.

According to an exemplary embodiment, first side 110 is configured to support flashlight 10 in a first orientation, second side 120 is configured to support flashlight 10 in a second orientation, and third side 130 is configured to support flashlight 10 in a third orientation. Second side 120 and third side 130 allow an operator to select an appropriate orientation for solar panel 40 (e.g., based on the orientation of support surface 180, based on latitude, based on season, based on time of day, etc.).

Figure 9:
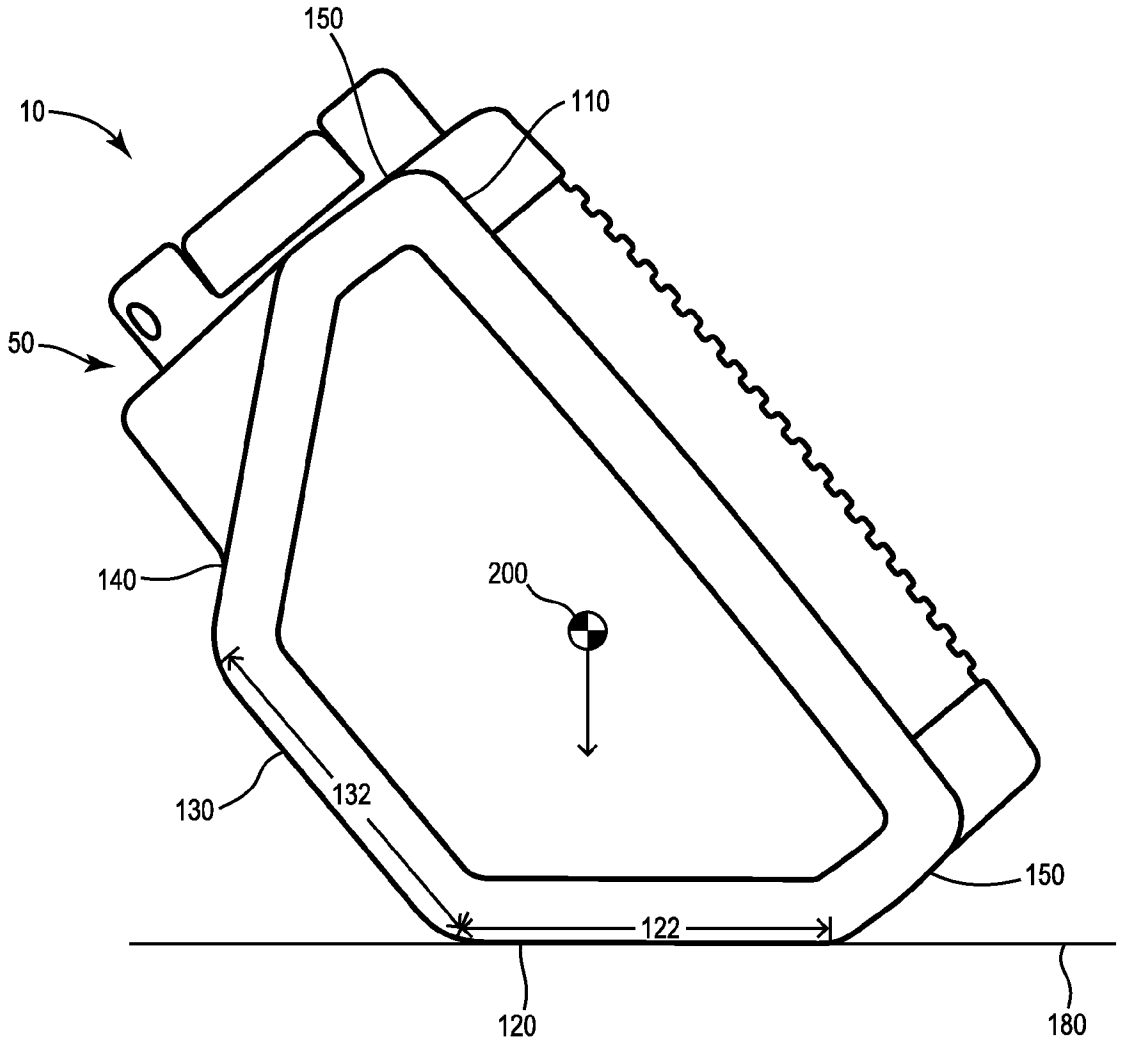
FIG. 9 is a schematic view of the portable lighting device shown in FIG. 1, according to an exemplary embodiment.

Referring next to FIG. 9, various components are positioned to improve the stability of flashlight 10. In one embodiment, at least one of battery 42 and dynamo 50 are positioned to improve the stability of flashlight 10. By way of example, battery 42 and dynamo 50 may be positioned to reduce the risk of tipping flashlight 10 from a desired orientation. As shown in FIG. 9, flashlight 10 has a center of gravity 200. In one embodiment, battery 42 and dynamo 50 each have a center of gravity that generate weight forces downward. According to an exemplary embodiment, the centers of gravity of battery 42 and dynamo 50 are positioned such that center of gravity 200 is disposed above (e.g., directly above, etc.) second side 120 when second side 120 is positioned horizontally. Weight forces of battery 42 and dynamo 50 may extend vertically downward when second side 120 is positioned horizontally. In one embodiment, a center of gravity of battery 42 is disposed below and on a first lateral side of center of gravity 200 (e.g., below and to the right when viewed from the end shown schematically in FIG. 9, etc.). Battery 42 may include a plurality of battery cells arranged coaxially and disposed end-to-end along the length of flashlight 10, thereby positioning the centers of gravity thereof below and on the first lateral side of center of gravity 200. A center of gravity of dynamo 50 may be disposed above and on an opposing second lateral side of center of gravity 200 (e.g., above and to the left when viewed from the end shown schematically in FIG. 9, etc.). The centers of gravity of battery 42 and dynamo 50 may combine, along with other components of flashlight 10, to produce center of gravity 200. Accordingly, the weight forces of battery 42 and dynamo 50 combine to increase the stability of flashlight 10 rather than cause flashlight 10 to tip (e.g., about an interface coupling second side 120 and third side 130, etc.).

As shown in FIG. 9, battery 42 and dynamo 50 are positioned to also improve the stability of flashlight 10 when housing 20 is supported in the third orientation. By way of example, third side 130 may be disposed (e.g., supported, held, etc.) along support surface 180. The center of gravity of at least one of battery 42 and dynamo 50 is positioned such that center of gravity 200 is disposed above (e.g., directly above, etc.) third side 130 when third side 130 is positioned horizontally, according to an exemplary embodiment. With third side 130 supported horizontally, weight forces of battery 42 and dynamo 50 may extend vertically downward. Accordingly, the weight forces of battery 42 and dynamo 50 increase the stability of flashlight 10 rather than cause flashlight 10 to tip (e.g., about an interface coupling second side 120 and third side 130, about an interface coupling third side 130 and fourth side 140, etc.) when housing 20 is supported in the second orientation or the third orientation. In other embodiments, various other components of flashlight 10 (e.g., solar panel 40, etc.) are positioned to improve the stability thereof when housing 20 is supported along first side 110, second side 120, or third side 130. In still other embodiments, flashlight 10 includes a counterweight positioned to improve the stability thereof when housing 20 is supported along first side 110, second side 120, or third side 130.

According to an exemplary embodiment, housing 20 is shaped to improve the stability of flashlight 10. In one embodiment, second side 120 has a specified length, shown as length 122. Length 122 is intended to improve the stability of housing 20 (e.g., when second side 120 is positioned horizontally). In another embodiment, third side 130 has a specified length, shown as length 132. Length 132 is intended to improve the stability of housing 20 (e.g., when third side 130 is positioned horizontally). Housing 20 includes first side 110 and second side 120 having length 122 and length 132, respectively, to decrease the distance (e.g., a horizontal distance when viewed from the side or in a cross-section of housing 20) between the centers of gravity of the various components of flashlight 10 and the centerlines of second side 120 and third side 130. By way of example, with housing 20 in the second orientation as shown in FIG. 9, length 122 reduces the distance (e.g., the lateral distance, the horizontal distance, etc.) between center of gravity 200 and a midpoint along second side 120. By way of another example, with housing 20 in the third orientation (e.g., with third side 130 disposed along third side 130), length 132 reduces the distance (e.g., the lateral distance, the horizontal distance, etc.) between center of gravity 200 and a midpoint along third side 130.

The construction and arrangement of the systems as shown in the various exemplary embodiments are illustrative only. Although only a few embodiments have been described in detail, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. A portable lighting device, comprising:

a housing including a first wall coupled to a second wall and defining an internal volume;

a battery positioned within the internal volume and having a center of gravity; a handle;

a dynamo coupled to the battery and the handle, positioned within the internal volume, and having a center of gravity, wherein the dynamo is configured to generate electrical power to charge the battery in response to rotation of the handle, wherein the center of gravity of the battery and the center of gravity of the dynamo are positioned such that a combined center of gravity of the portable lighting device is disposed directly above the second wall when the second wall is positioned horizontally;

a lighting element coupled to the battery; and a solar panel disposed along the first wall and coupled to the battery, wherein the second wall of the housing is angled relative to the first wall of the housing such that the solar panel is positioned in a target orientation when the second wall is disposed along a support surface.

2. The portable lighting device of claim 1, wherein the second wall is positioned at an angle of between 45 and 55 degrees relative to the first wall.

3. The portable lighting device of claim 1, wherein the housing is elongate and defines a longitudinal direction, and wherein the first wall and the second wall extend along the longitudinal direction.

4. The portable lighting device of claim 3, wherein the housing defines a first end separated from a second end by a body portion.

5. The portable lighting device of claim 4, wherein the lighting element is coupled to at least one of the first end and the second end of the housing, and wherein the lighting element is positioned to emit light along the longitudinal direction.

6. The portable lighting device of claim 4, wherein the lighting element is coupled to the body portion and positioned to emit light along a direction that is orthogonal to the first wall.

7. The portable lighting device of claim 4, further comprising a hook coupled to at least one of the first end and the second end of the housing, wherein the hook is shaped to contour a side profile of the housing.

8. The portable lighting device of claim 1, wherein the second wall has a specified length that stabilizes the housing when the second wall is positioned horizontally.

9. A portable lighting device, comprising:

a housing including a first surface and a second surface, wherein the housing defines an internal volume configured to contain a battery;

a lighting element coupled to the housing;

a battery positioned within the internal volume and having a center of gravity; a handle;

a dynamo coupled to the battery and the handle, positioned within the internal volume, and having a center of gravity, wherein the dynamo is configured to generate electrical power to charge the battery in response to rotation of the handle, wherein the center of gravity of the battery and the center of gravity of the dynamo are positioned such that a combined center of gravity of the portable lighting device is disposed directly above the second wall when the second wall is positioned horizontally; and a solar panel disposed along the first surface, wherein at least a portion of the second surface of the housing is offset relative to the first surface of the housing such that the solar panel is positioned in a target orientation when the housing is supported along the second surface.

10. The portable lighting device of claim 9, wherein the second surface has a specified length that stabilizes the housing when the second surface is positioned horizontally.

11. A portable lighting device, comprising:

a housing including a first side coupled to a second side, wherein the first side is configured to support the housing in a first orientation and the second side is configured to support the housing in a second orientation;

a battery positioned within an internal volume of the housing and having a center of gravity; a handle;

a dynamo coupled to the battery and the handle, positioned within the internal volume, and having a center of gravity, wherein the dynamo is configured to generate electrical power to charge the battery in response to rotation of the handle, wherein the center of gravity of the battery and the center of gravity of the dynamo are positioned such that a combined center of gravity of the portable lighting device is disposed directly above the second wall when the second wall is positioned horizontally;

a lighting element coupled to the battery; and a solar panel coupled to the first side of the housing, wherein the second side is angled relative to the first side such that the solar panel generates a target electrical power when the housing is positioned in the second orientation.

12. The portable lighting device of claim 11, wherein the housing includes a third side coupled to the second side, wherein the third side is configured to support the housing in a third orientation.

13. The portable lighting device of claim 12, wherein the third side is parallel to the first side.

14. The portable lighting device of claim 12, wherein the center of gravity of the battery is positioned such that the combined center of gravity is disposed directly above the third side when the third side is positioned horizontally.

15. The portable lighting device of claim 14, further wherein the center of gravity of the dynamo is positioned such that the combined center of gravity is disposed directly above the third side when the third side is positioned horizontally.

* * * * *